US005372480A

United States Patent [19]

Van Meter et al.

[11] Patent Number: 5,372,480

[45] Date of Patent: Dec. 13, 1994

[54] REPLACEABLE AND FOLDABLE BLADE BOAT PROPELLER

[76] Inventors: John L. Van Meter, P.O. Box 533; George H. Van Meter, P.O. Box 832, both of Mason, W. Va. 25260

[21] Appl. No.: 124,795

[22] Filed: Sep. 22, 1993

[51] Int. Cl.[5] ..... B63H 1/20

[52] U.S. Cl. ..... 416/214 R; 416/142; 416/220 A; 403/328

[58] Field of Search ..... 403/328; 416/142, 204 R, 416/214 R, 219 A, 220 A

[56] References Cited

U.S. PATENT DOCUMENTS

| | | | |
|---|---|---|---|
| 22,266 | 12/1858 | Perry | 416/204 |
| 2,395,193 | 2/1946 | Place | 416/220 A |
| 2,835,517 | 5/1958 | Beerli | 403/328 |

FOREIGN PATENT DOCUMENTS

| | | | |
|---|---|---|---|
| 1260071 | 3/1961 | France | 416/204 |
| 0303379 | of 1919 | Germany | 416/214 |
| 0096993 | 5/1924 | United Kingdom | 416/144 |
| 0878852 | 10/1961 | United Kingdom | 416/142 A |

*Primary Examiner*—Edward K. Look
*Assistant Examiner*—Mark Sgantzos
*Attorney, Agent, or Firm*—Hugh E. Smith

[57] ABSTRACT

A boat propeller wherein the blades are easily removable from the propeller hub on an individual basis to permit quick replacement for repair and/or for substituting blades of different pitch comprising a hub adapted to fit over and attach to a drive shaft; a plurality of removable blades positioned around said hub and extending radially therefrom, each of said blades comprising a water engaging blade portion and a rigid tang extending from the base and of such blade portion; a plurality of blade engaging sockets disposed on and around said hub, said sockets adapted to mate with and receive the tang of said blades; and preferably a cover plate adapted to fit over the portion of said tang within said socket, tang, cover plate each being provided with a plurality of aligned bolt holes; and a plurality of bolts extending through said aligned holes and holding each assembly thereof together. Further modifications include a blade assembly for use wherein less force will be exerted, e.g. an electric trolling motor drive, wherein the bolts may be substituted by a spring-loaded button retainer for the blade and the provision of folding blades to permit easier and safer storage of the propeller when off the drive shaft.

2 Claims, 4 Drawing Sheets

REPLACEABLE AND FOLDABLE BLADE BOAT PROPELLER

BACKGROUND OF THE INVENTION

1. Field of the Invention

The present invention relates to boat propeller and more particularly pertains to such propellers which may be easily repaired or modified by the quick replacement of one or more blades of such propeller.

2. Description of the Prior Art

The use of replaceable blades for boat propellers is known in the prior art. More specifically, such constructions heretofore devised and utilized for the purpose of replacing propellers are known to consist basically of familiar, expected and obvious structural configurations, notwithstanding the myriad of designs encompassed by the crowded prior art, and require fairly complicated efforts to remove and/or replace such blades. Typical of such prior art propellers are those illustrated in U.S. Pat. Nos. 4,068,979; 4,984,968; 4,692,097; and 3,790,304.

In this respect, the propeller construction according to the present invention substantially departs from the conventional concepts and designs of the prior art, and in so doing provides a propeller primarily developed for the purpose of easy blade removal and replacement.

Therefore, it can be appreciated that there exists a continuing need for new and improved boat propellers which can be easily repaired. In this regard, the present invention substantially fulfills this need.

SUMMARY OF THE INVENTION

In view of the foregoing disadvantages inherent in the known types of boat propellers now present in the prior art, the present invention provides an improved propeller construction wherein the blades thereof are easily changed. As such, the general purpose of the present invention, which will be described subsequently in greater detail, is to provide a new and improved removable blade boat propeller which has all the advantages of the prior art propellers and none of the disadvantages.

To attain this, the present invention essentially relates to a boat propeller wherein the blades are easily removable from the propeller hub on an individual basis to permit quick replacement for repair and/or for substituting blades of different pitch comprising a hub adapted to fit over and attach to a drive shaft; a plurality of removable blades positioned around said hub and extending radially therefrom, each of said blades comprising a water engaging blade portion and a rigid tang extending from the base and of such blade portion; a plurality of blade engaging sockets disposed on and around said hub, said sockets adapted to mate with and receive the tang of said blades; and preferably a cover plate adapted to fit over the portion of said tang within said socket, tang, cover plate each being provided with a plurality of aligned bolt holes; and a plurality of bolts extending through said aligned holes and holding each assembly thereof together. Further modifications include a blade assembly for use wherein less force will be exerted, e.g. an electric trolling motor drive, wherein the bolts may be substituted by a spring-loaded button retainer for the blade and the provision of folding blades to permit easier and safer storage of the propeller when off the drive shaft.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved boat propeller which has all the advantages of the prior art propellers and none of the disadvantages.

It is another object of the present invention to provide a new and improved boat propeller which may be easily and efficiently manufactured and marketed.

It is a further object of the present invention to provide a new and improved boat propeller which is of a durable and reliable construction.

An even further object of the present invention is to provide a new and improved boat propeller which is susceptible of a low cost of manufacture with regard to both materials and labor, and which accordingly is then susceptible of low prices of sale to the consuming public, thereby making such propellers economically available to the buying public.

Still yet another object of the present invention is to provide a new and improved boat propeller which provides in the apparatuses and methods of the prior art some of the advantages thereof, while simultaneously overcoming some of the disadvantages normally associated therewith.

Still another object of the present invention is to provide a new and improved boat propeller with easily replaceable blades.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
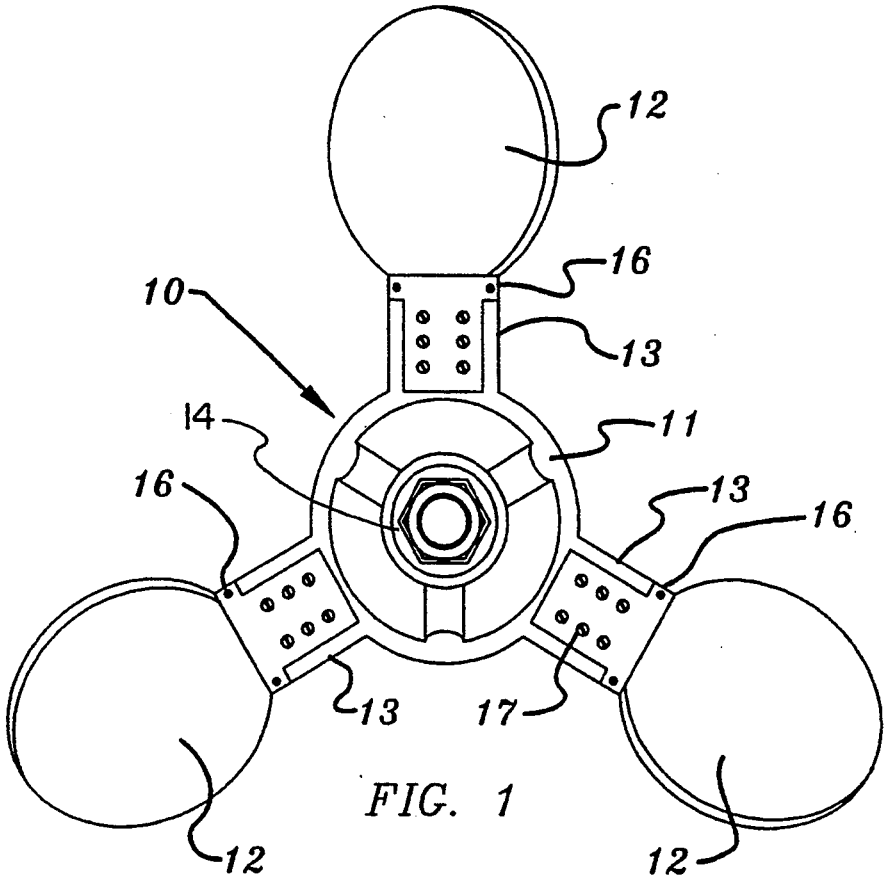
FIG. 1 is a front plan view of the preferred embodiment of the present invention.

With reference now to the drawings, and in particular to FIG. 1 thereof, a new and improved propeller embodying the principles and concepts of the present invention and generally designated by the reference numeral 10 will be described.

More specifically, it will be noted that the propeller 10 comprises a hub 11 and a plurality of radially projecting blades 12. A plurality of sockets or blade receivers 13 are affixed to hub 11 in spaced relationship therearound. Hub 11 has a central shaft receiving means 14 therein. Each blade 12 has an integral tang 15 (shown in subsequent Figures) at the base thereof designed to slip into and mate within the receiver 13. Covering such tang 15 is a cover plate 16, such cover plate 16 being secured to the tang 15 and receiver 13 by a plurality of bolts 17.

Figure 2:
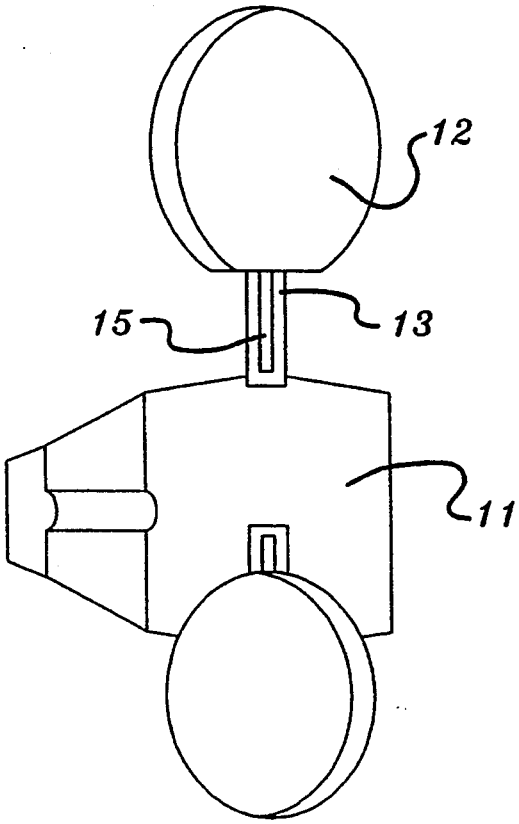
FIG. 2 is a schematic side elevation of the device in FIG. 1.

FIG. 2 schematically shows tangs 15 of blades 12 inserted into receiver 13 spaced around hub 11.

Figure 3:
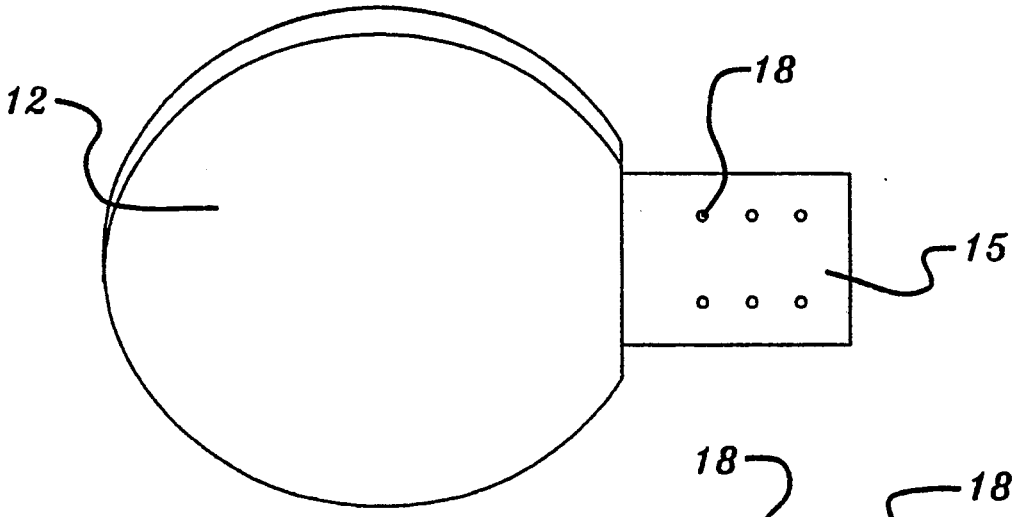
FIG. 3 is a side plan view of one of the blades shown in FIGS. 1 and 2.

FIG. 3 illustrates one blade 12 and its integral tang 15. Also shown in this view are a plurality of bolt holes 18 designed to align with similar holes in the cover plate 1 and receiver 13 to receive bolts 17 as shown in FIG. 1.

Figure 4:
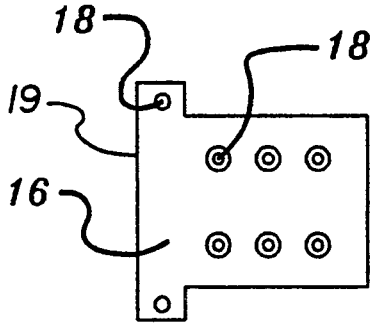
FIG. 4 is a top plan view of the cover plate element used in the embodiment of FIG. 1.

FIG. 4 shows the cover plate 16 having similar bolt holes 18. The end 19 of cover plate 16 is wider than the body of plate 16 to provide additional stability when the reduced tang 15 meets the body of blade 12 and also is provided with bolt holes 18.

Figure 5:
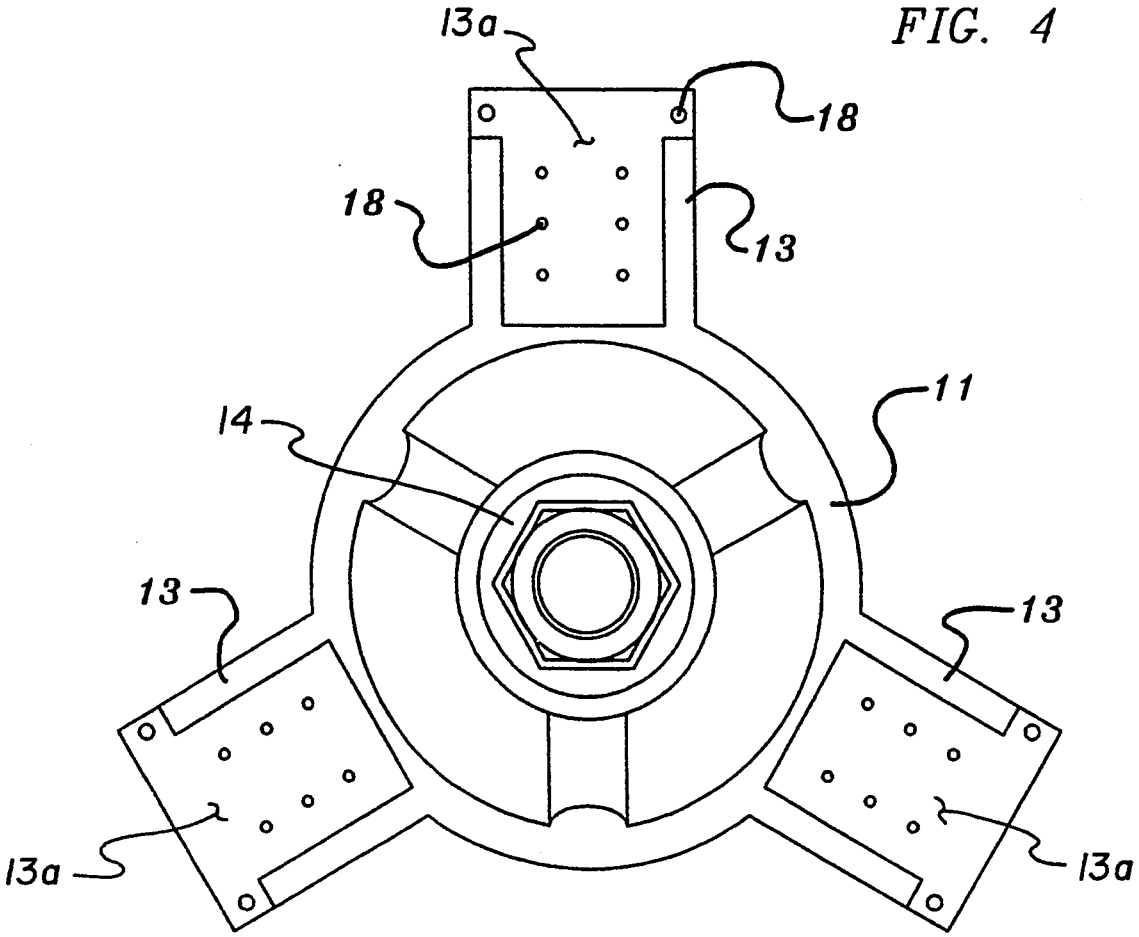
FIG. 5 is a front plan view of the propeller hub of FIG. 1.

In FIG. 5, the receivers 13 are clearly shown forming projecting sockets 13*a* from hub 11 to receive tangs 15 of blades 12. Corresponding bolt holes 18 are also provided in the receiver body 13. The plurality of bolt holes (and associated bolts 17) are so spaced as to provide rigid anchorage for the propeller blades 12 against torsional forces exerted as the propeller spins in the water. It will be seen that by merely unbolting each blade, it can readily be withdrawn from hub 11 and replaced if damaged or substituted for with a blade of different pitch if such is received by the performance desired from the propeller.

Figure 6:
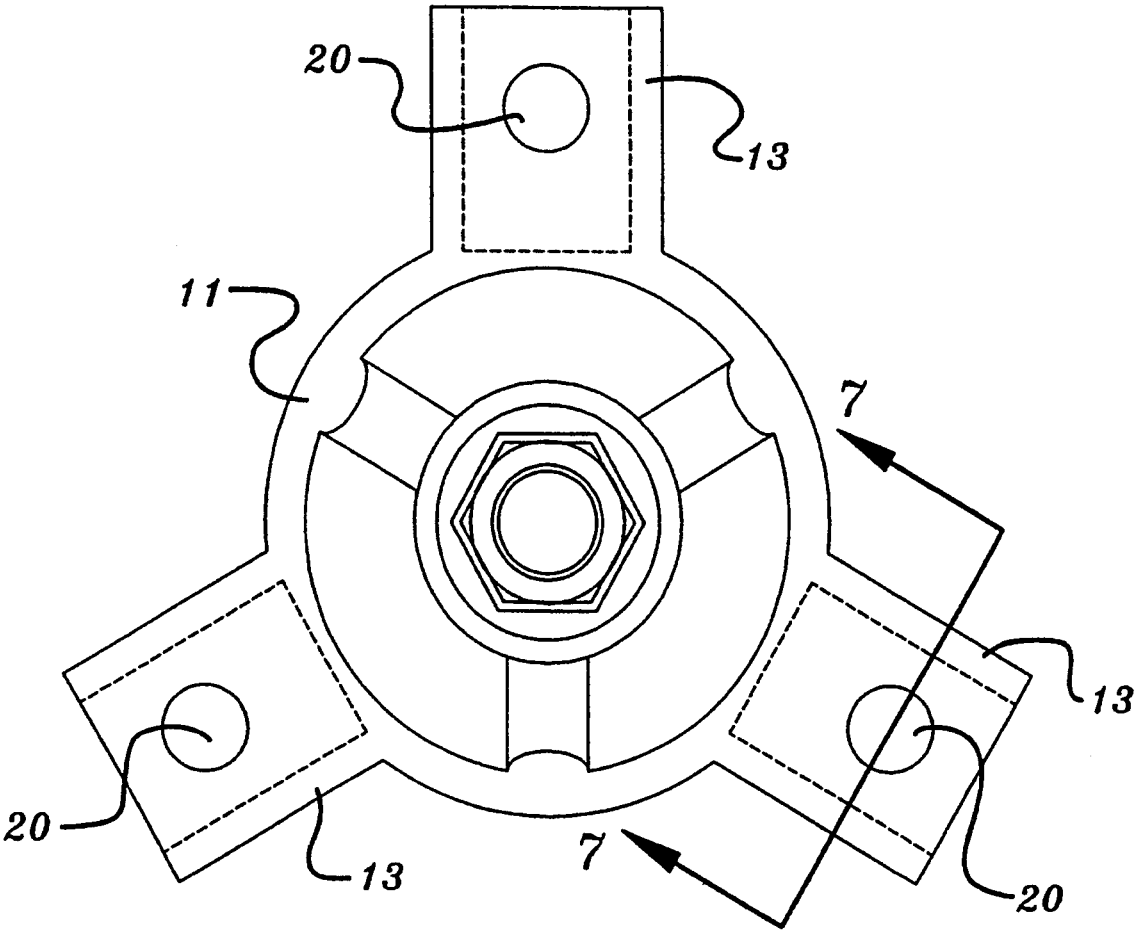
FIG. 6 is a front plan view of a modification of the present invention.
Figure 7:
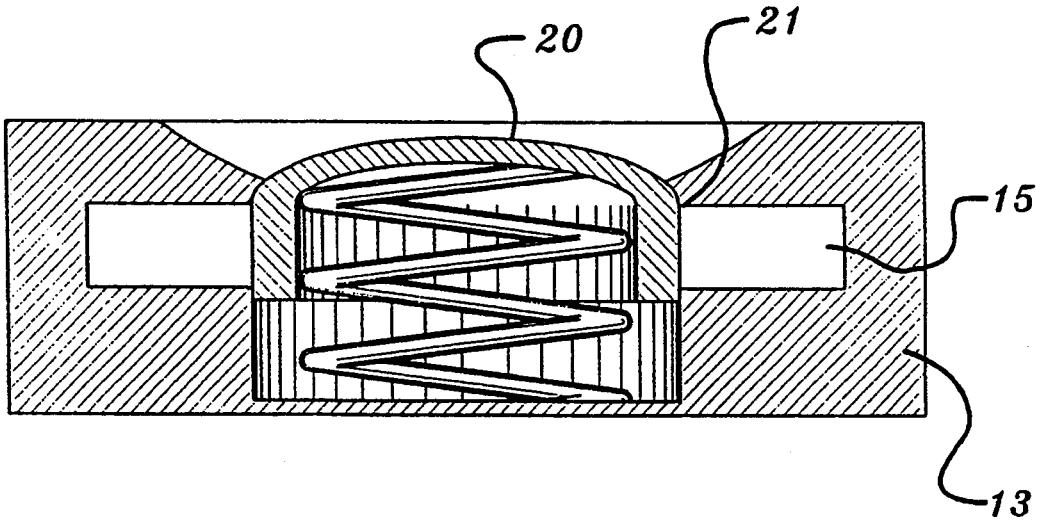
FIG. 7 is a sectional view on line 7—7 of FIG. 6.

FIGS. 6 and 7 illustrate a modification designed for light duty propeller wherein the means fastening the tangs 15 of propeller blades 12 consists of a spring-loaded button 20 adapted to pass through and retain in place the tang 15. Button 20 is integral to the receiver 13 and when depressed allows the tang 15 to be inserted or withdrawn from such receiver 13. In this modification, the tang 15 has a centrally located aperture 21 which receives the spring-loaded button 20. While not providing as rigid a connection as the plurality of bolts shown in the preceding Figures, this modification provides a much quicker replacement procedure and is particularly useful with small trolling type motors, e.g. electric motors, where torsional force will be less than with larger motors.

Figure 8:
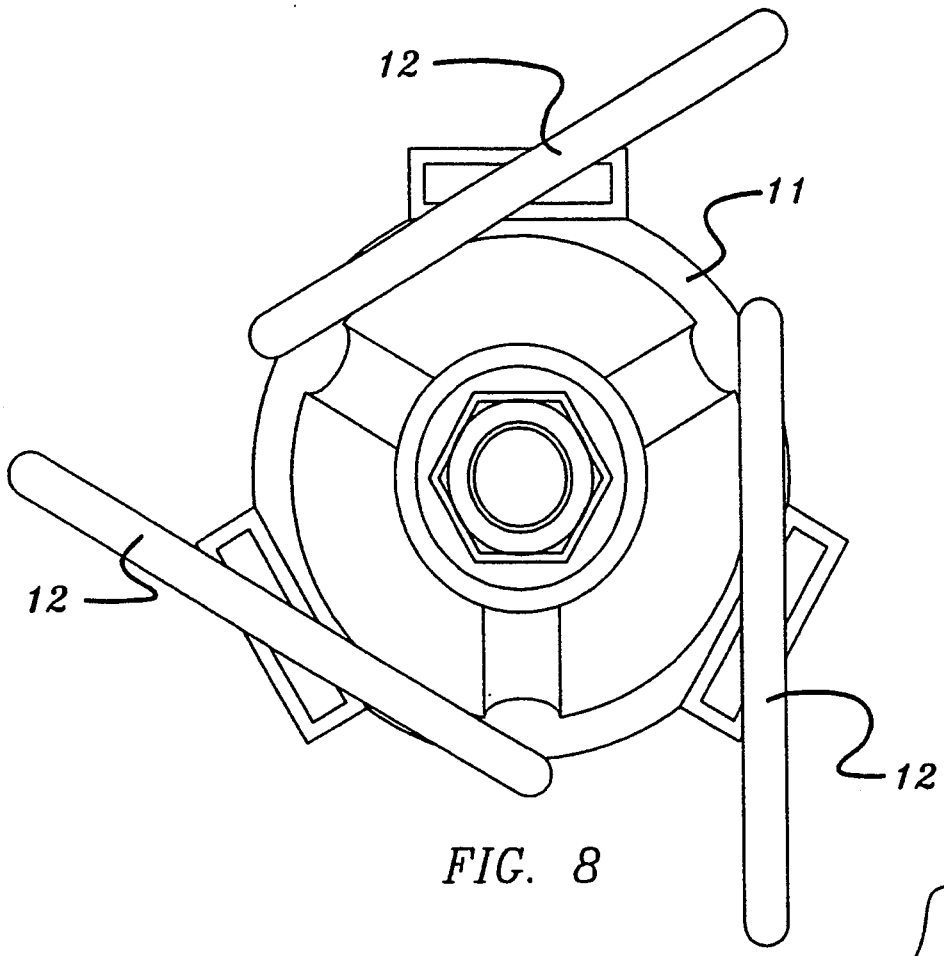
FIG. 8 is a front plan view of a further modification of the invention.
Figure 9:
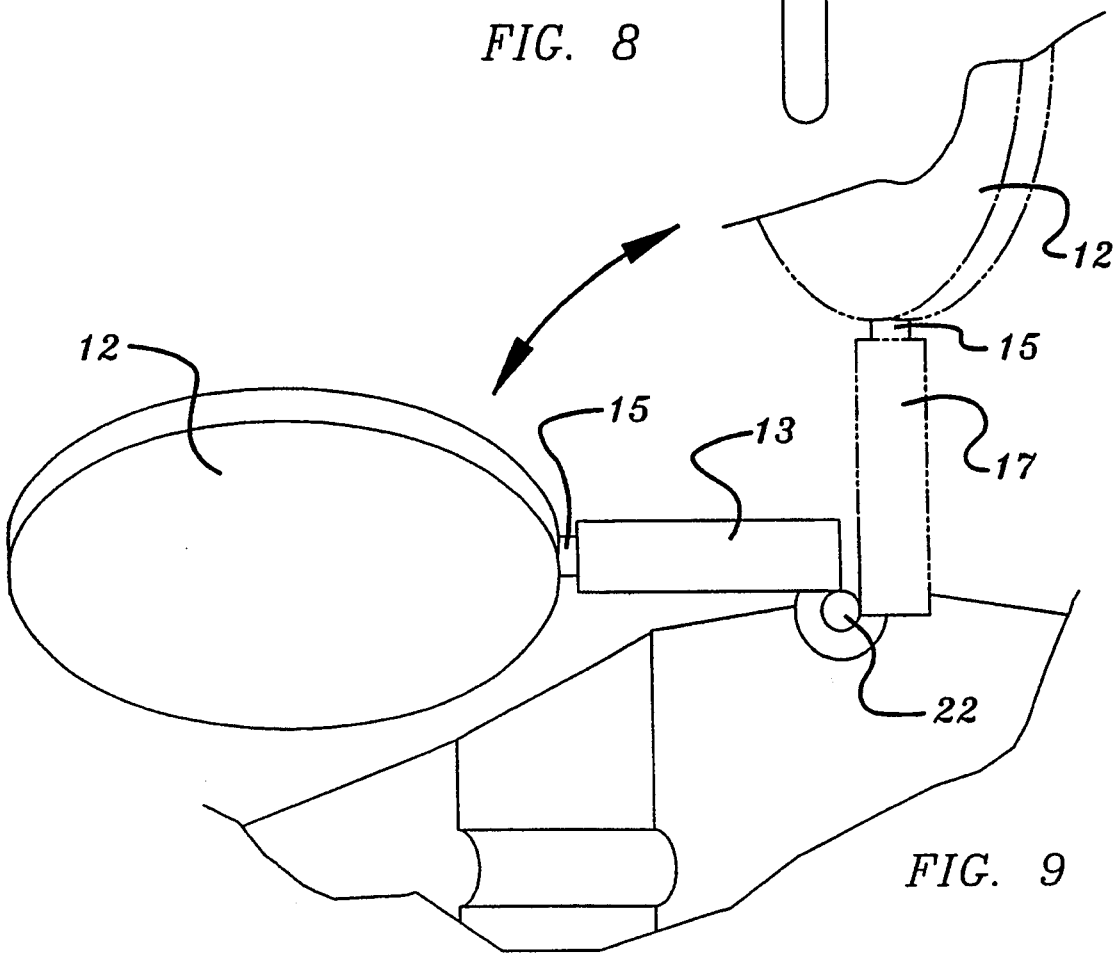
FIG. 9 is a partial perspective view of the device of FIG. 8.

FIGS. 8 and 9 illustrate the provision of folding blades 12 wherein the receiver 13 is pivoted at hub 11 as shown at 22 such construction permits easier storage of the propeller when off the drive shaft.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A replaceable and foldable blade boat propeller having easily removable blades, said boat propeller comprising:

a central hub attachable to a drive shaft;

a plurality of blade receiver members each having a socket formed therein, said blade receiver members being pivotally coupled to said central hub and positioned therearound in a radially spaced relationship, each of said blade receiver members having a plurality of bolt holes formed therein, each of said blade receiver members being foldable from a first radially extending position wherein said blade receiver members are oriented orthogonally relative to a longitudinal axis of said central hub to a second folded position wherein said receiver members are oriented parallel relative to said longitudinal axis of said central hub;

a plurality of removable driving blades each having a water-engaging surface and a reduced tang portion integrally formed at a base thereof, each of said tang portions having a plurality of bolt holes formed therein and being positioned within said socket of an individual one of said receiver members;

a plurality of cover plates, each of said cover plates having a plurality of bolt holes formed therein and being positioned over an individual one of said tang portions such that said plurality of bolt holes in said cover plate are aligned with said plurality of bolt holes in said tang portion and said plurality of bolt holes in said receiver member; and, a plurality of bolts, each of said bolts extending through said an individual one of said bolt holes to threadably engage said receiver member, thereby securing said cover plate and said tang portion and said driving blade to said receiver member.

2. A replaceable and foldable blade boat propeller having easily removable blades, said boat propeller comprising:

a central hub attachable to a drive shaft;

a plurality of blade receiver members each having a socket formed therein, said blade receiver members being pivotally coupled to said central hub and positioned therearound in a radially spaced relationship, each of said blade receiver members being foldable from a first radially extending position wherein said blade receiver members are oriented orthogonally relative to a longitudinal axis of said central hub to a second folded position wherein said receiver members are oriented parallel relative to said longitudinal axis of said central hub;

a plurality of removable driving blades each having a water-engaging surface and a reduced tang portion integrally formed at a base thereof, each of said tang portions having a hole formed therein and being positioned within said socket of an individual one of said receiver members; and, a plurality of spring loaded buttons, each of said spring loaded buttons being mounted within said socket of an individual one of said receiver members to removably project through said hole in said tang portion of said driving blade, thereby removably securing said tang portion and said driving blade to said receiver member.

* * * * *